US008622042B2

(12) United States Patent
Laimboeck

(10) Patent No.: US 8,622,042 B2
(45) Date of Patent: Jan. 7, 2014

(54) BEARING CONNECTION, ENGINE CYLINDER, AND ENGINE WITH THE BEARING CONNECTION

(75) Inventor: Franz J. Laimboeck, Goleta, CA (US)

(73) Assignee: Mahle Koenig Kommanditgesellschaft GmbH & Co. KG, Rankweil (AT)

( * ) Notice: Subject to any disclaimer, the term of this patent is extended or adjusted under 35 U.S.C. 154(b) by 0 days.

(21) Appl. No.: 13/604,835

(22) Filed: Sep. 6, 2012

(65) Prior Publication Data

US 2013/0220267 A1 Aug. 29, 2013

Related U.S. Application Data

(60) Provisional application No. 61/531,395, filed on Sep. 6, 2011.

(51) Int. Cl.
*F02B 75/32* (2006.01)

(52) U.S. Cl.
USPC ..... 123/197.4; 123/197.2; 123/41.35; 123/53.6; 74/50

(58) Field of Classification Search
USPC ..... 123/197.4, 197.2, 197.3, 41.35, 41.34, 123/41.37, 196 R, 52.1, 53.6, 54.1, 54.4; 74/50
See application file for complete search history.

(56) References Cited

U.S. PATENT DOCUMENTS

| | | | | |
|---|---|---|---|---|
| 1,089,645 | A | 3/1914 | Jenkins | |
| 4,459,945 | A * | 7/1984 | Chatfield | 123/55.3 |
| 5,092,185 | A | 3/1992 | Zornes et al. | |
| 6,065,440 | A * | 5/2000 | Pasquan | 123/198 F |
| 7,650,870 | B2 * | 1/2010 | Fisher | 123/197.4 |
| 8,327,819 | B2 * | 12/2012 | Voegeli | 123/197.1 |
| 8,375,919 | B2 * | 2/2013 | Cook et al. | 123/197.4 |
| 2001/0017122 | A1 * | 8/2001 | Fantuzzi | 123/197.4 |
| 2004/0255879 | A1 * | 12/2004 | Zaytsev | 123/55.2 |
| 2008/0141921 | A1 | 6/2008 | Hinderks | |
| 2008/0163848 | A1 * | 7/2008 | Lemke et al. | 123/197.3 |
| 2011/0146601 | A1 * | 6/2011 | Fisher | 123/62 |

FOREIGN PATENT DOCUMENTS

| | | | |
|---|---|---|---|
| DE | 19821074 | A1 | 11/1999 |
| JP | 62153581 | A | 7/1987 |
| JP | 2009264143 | A | 11/2009 |
| WO | 02059502 | A1 | 8/2002 |

* cited by examiner

*Primary Examiner* — Noah Kamen
*Assistant Examiner* — Grant Moubry
(74) *Attorney, Agent, or Firm* — Laurence A. Greenberg; Werner H. Stemer; Ralph E. Locher

(57) ABSTRACT

A bearing connection having a connecting rod connected rigidly to a piston and a crankshaft driven by the connecting rod. The connecting rod is connected on the crankshaft side to a transverse bearing for a sliding block, the sliding block being mounted such that it can move to and fro in the transverse bearing and a rolling contact bearing being arranged in the sliding block in order to receive the crank pin of a crankshaft. At least one cavity is formed in the piston crown and, in the area thereof close to the piston longitudinal axis, is connected to an oil feed line running through the connecting rod and that the oil feed line in the connecting rod is led or extended to the end region thereof remote from the piston and, from there, is led onward into the interior of the transverse bearing via a transfer channel.

23 Claims, 12 Drawing Sheets

BEARING CONNECTION, ENGINE CYLINDER, AND ENGINE WITH THE BEARING CONNECTION

CROSS-REFERENCE TO RELATED APPLICATION

This application claims the benefit, under 35 U.S.C. §119 (e), of provisional patent application No. 61/531,395 filed Sep. 6, 2011; the prior application is herewith incorporated by reference in its entirety.

BACKGROUND OF THE INVENTION

Field of the Invention

The invention relates to a bearing connection having a connecting rod connected rigidly to a piston and a crankshaft driven by the connecting rod, the connecting rod being connected on the crankshaft side to a transverse bearing for a sliding block, the sliding block being mounted such that it can move to and fro in the transverse bearing and a rolling contact bearing being arranged in the sliding block in order to receive the crank pin of a crankshaft. Furthermore, the invention relates to an engine cylinder having at least one piston. Finally, the invention relates to an engine and an opposed-piston engine, each of which is connected to a crankshaft by a bearing connection according to the invention.

SUMMARY OF THE INVENTION

The object of the invention is to establish a bearing connection having a long service life at high rotational speeds. A cylinder or engine having such a bearing connection, just like the bearing connection, is intended to be simple and inexpensive to manufacture and suitable for all operating situations.

According to the invention, in a bearing connection of the type mentioned at the beginning, these objects are achieved with the invention as claimed, namely, in that at least one cavity is formed in the piston crown and, in the area thereof close to the piston longitudinal axis, is connected to an oil feed line running through the connecting rod and in that the oil feed line in the connecting rod is led or extended to the end region thereof remote from the piston and, from there, is led onward into the interior of the transverse bearing via a transfer channel.

The bearing connection constructed in accordance with the invention has a long life and low friction and offers high wear resistance. The throughput of oil for cooling purposes is made possible and configured optimally by the accelerations during the reciprocating movements of the piston. Furthermore, there is a structurally simple construction.

A simple structure with a long service life is achieved if the transverse bearing and the connecting rod are formed in one piece or from one part, in particular a precision cast part.

There is also provided an engine cylinder having a piston and a connecting rod and having a bearing connection as summarized above, and which has a guide, in which the connecting rod is mounted and guided, in the base area remote from the combustion chamber of said cylinder.

In terms of construction, friction and cooling, it is advantageous if the sliding block is formed in two parts, and the two parts enclose the rolling contact bearing, preferably a needle bearing, for the crank guide, or if the sliding block is formed in one piece and if the rolling contact bearing has a filling groove and the rolling contact bearing is threaded onto the crank guide and/or if the sliding block is guided in the transverse bearing such that it can be displaced on rollers in a direction transverse with respect to the cylinder longitudinal axis and/or the transverse bearing or the bearing recess thereof has a rectangular internal cross section, if appropriate with internal corners having a rounded course.

In order to achieve an improvement to the cooling, provision is made that the cavity is formed by a number of channels preferably running radially in the piston crown, possibly connected to one another, in particular connected to one another and/or branching in the circumferential region of the piston.

In practice, it has been shown that it is advantageous for the flow of oil if the cavity or the channels forming the cavity and/or the return line are inclined at an angle of 1° to 4°, preferably 1° to 3°, to a plane perpendicular to the piston longitudinal axis, the peripheral end of the cavity or of the channels forming the cavity being closer to the piston surface on the combustion chamber side than the return line.

The cooling of the piston is carried out by means of oil that is supplied, which oil is supplied to the piston crown by the accelerations during the reciprocating movements of the piston and is transported away from the piston crown. With such an arrangement, a high throughput of oil for cooling the piston is possible. Furthermore, the oil transported away can be used to lubricate the crankshaft and led away into the crankshaft chamber for further use. Efficient cooling of the piston via the piston crown takes place, the cooling above all also being possible in the edge regions of the piston.

A simple structure results if the cavity or the channels forming the cavity in the circumferential region of the piston are connected, possibly via a collecting line running peripherally, to at least one return line leading to the connecting rod, the return line being connected to an oil return line guided in the connecting rod, and the cavity or the channels forming the cavity being closer to the end face of the piston than the return lines.

For a simple structure, provision can advantageously be made that the oil feed line is guided centrally in the connecting rod and/or that an oil return line connected to the return line is arranged peripherally or off-centre in the connecting rod.

Simple manufacture and a stable structure of the bearing connection and of the piston result if the piston is formed centrally symmetrically with respect to the longitudinal mid-axis thereof and/or if the piston is connected to the connecting rod via a connecting part, preferably in the form of a hollow screw, firmly and rigidly, but if appropriate detachably and divisibly, the oil feed line being extended into a recess in the connecting part which, in the top area of the connecting part, has outlet openings which open into the cavity or the channels forming the cavity.

Simple guidance of the oil drawn in for cooling purposes results if a connecting bore is formed in the connecting rod at a distance from the piston and leads radially from the surface of the connecting rod to the centrally placed oil feed line.

It is also advantageous if the transfer channel opens into a bearing recess enclosed by the transverse bearing and/or if a bore is formed in the sliding block and passes through the sliding block between the opposite wall faces of the latter and/or if, in the wall surface of the sliding block close to the piston, a depression located opposite the connecting rod is formed, in the area of which the transfer channel opens, which depression has at least one transverse extent which corresponds to the offset of the sliding block during the to and fro movement of the latter.

It is also possible that the transverse bearing is connected to a respective connecting rod on opposite sides, the two connecting rods preferably being aligned coaxially.

It may be advantageous for the operation if the sliding block and the transverse bearing are fixed in one plane by a guide unit and are secured against mutual rotation about the piston axis.

It is advantageous for the interaction of cylinder, engine piston and bearing connection if the cylinder has a guide, in which the connecting rod is mounted, in the base area of the cylinder remote from the combustion chamber. Provision is made that the guide closes off the cylinder or the end thereof remote from the combustion chamber.

In an advantageous embodiment of the invention, provision is made that the guide closes off the cylinder or the end thereof remote from the combustion chamber and/or that at least one groove is formed in the guide, in which there is arranged a metallic oil scraper ring for the connecting rod, sealing off on the inside. Therefore, the oil used for cooling purposes and leaving the piston can be used directly for lubricating the connection of the connecting rod to the crank rocker or the crankshaft, preferably the bearing connecting the connecting rod to the crankshaft.

It is advantageous if an oil supply line is formed in the guide along the guide path for the connecting rod and communicates with the connecting bore, at least over half the piston travel, beginning with the upper dead point of the piston.

The pressures in the cooling oil are high, caused by the acceleration/deceleration of several hundred g. The connecting bore is not connected to the oil supply line in the region of the bottom dead center or at the bottom dead center, with the result that the static pressure which prevails in the oil can escape only via the transfer channel, to the benefit of the lubrication of the sliding block.

An opposed-piston engine according to the invention comprises two cylinders constructed in accordance with the invention, in each of which a piston is mounted, provision being made that the cylinders are connected to each other by the cylinder wall on the combustion chamber side, are advantageously formed in one piece or one part and form a continuous cylinder wall, and that the pistons arranged in the cylinder execute opposed strokes, and that the two pistons are connected to one crankshaft respectively via a bearing connection according to the invention.

Advantageously, a bearing connection according to the invention can be used for 180° V engines, to which end provision can be made that the two cylinders are arranged on both sides of the crankshaft, and the connecting rod of each cylinder is connected, preferably in one piece, to the transverse bearing placed on the crankshaft.

Other features which are considered as characteristic for the invention are set forth in the appended claims.

Although the invention is illustrated and described herein as embodied in a bearing connection, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
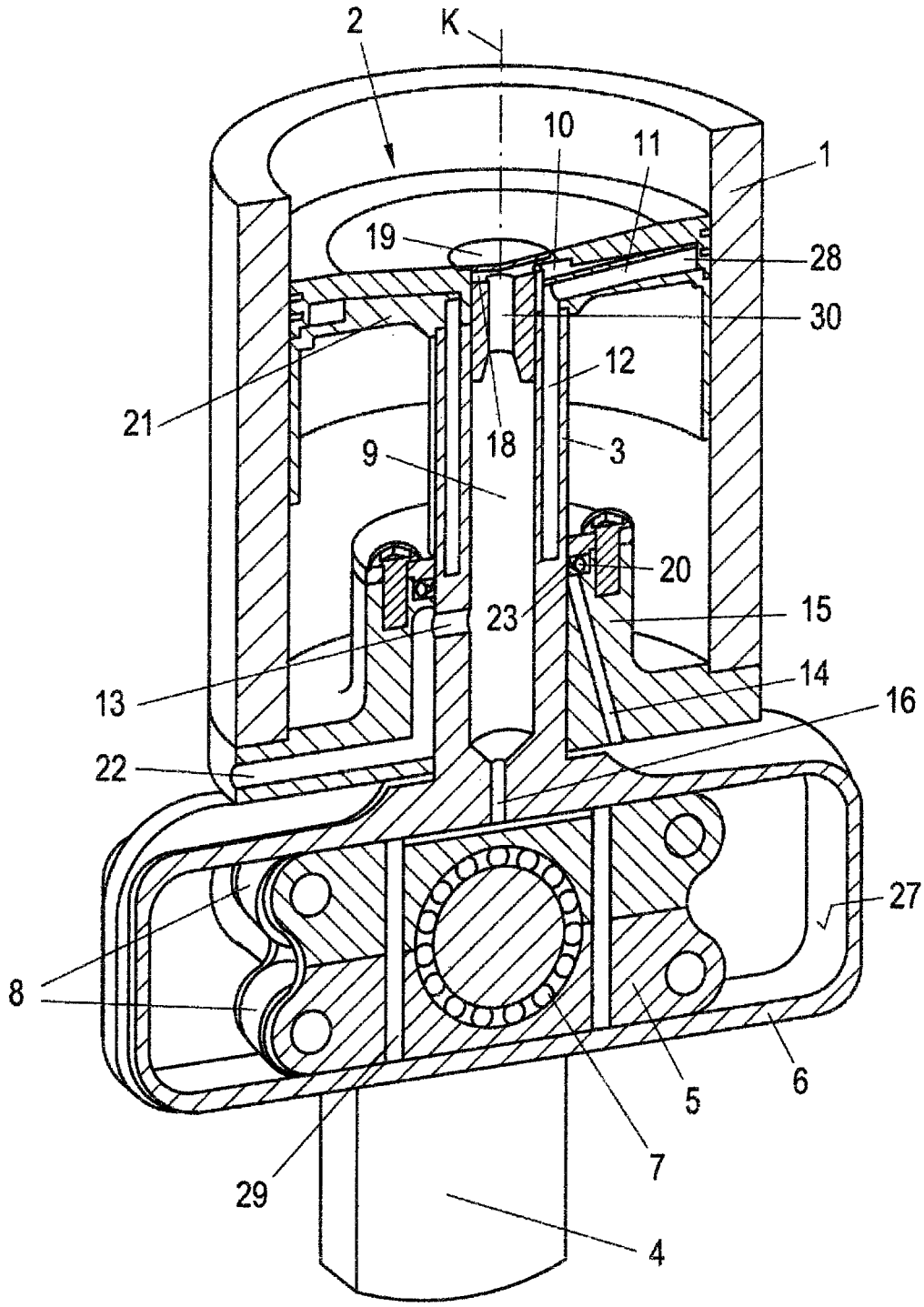
FIG. 1 shows a schematic section of a cylinder with a piston arranged in the latter and a bearing connection having a sliding bearing for a crankshaft connected to the piston via a connecting rod.

FIG. 1 shows a schematic section of an engine cylinder 1, of which the combustion chamber can be closed by a cylinder head, not shown, in which ignition units and/or units for the introduction of fuel and/or fuel-air mixtures can be arranged. In the end area of the cylinder 1 remote from the combustion chamber there is formed a guide 15, which closes off the volume of the cylinder 1 remote from the combustion chamber and is connected to the cylinder wall and at the same time guides a connecting rod 3 which is connected rigidly to a piston 2. The connection between connecting rod 3 and piston 2 can be made detachably with a connecting part 19 formed by a cap or hollow screw which has an oil guide 30 and at least one oil outlet opening 18. In the end area remote from the combustion chamber, the connecting rod 3 bears a transverse bearing 6, in which a sliding block 5 is mounted such that it can be displaced at right angles to the axis of the connecting rod. This sliding block 5 is displaceably mounted by means of rollers 8 in a bearing recess 27 in the transverse bearing 6. The sliding block 5 is formed in two parts, it being possible for the two parts to be connected firmly to each other by means of screws 17. Arranged in the sliding block 5 is a rolling contact bearing 7, advantageously a needle bearing, to receive a crank pin 24 of a crankshaft 4.

Formed in the connecting rod 3 is an oil feed line 9, which is connected via a connecting bore 13 to an oil supply line 22 coming from the crankshaft casing or an oil sump, which oil supply line 22 is led through the guide 15. Starting from the area of top dead center, the oil supply line 22 and the connecting bore 13 communicate over a certain length of the stroke, so that oil can be conveyed into the oil feed line 9. In the present case, in the guide 15 along the guide path for the connecting rod 3 there is formed an oil supply line 22, which communicates with the connecting bore 13 at least over half the piston travel to and from top dead center of the piston 2.

The oil feed line 9 is located centrally in the connecting rod 3 and is led onward in the connecting or retaining part 19, which is inserted into the connecting rod 3 and is placed in the center of the piston 2. This connecting or retaining part 19 is used firstly to form oil guide channels, as will be explained below. Secondly, this retaining or connecting part 19 also serves to configure the connection between piston 2 and connecting rod 3 to be rigid and firm, but in particular also divisible or detachable. The connecting or retaining part 19, extending the oil feed line 9 through the connecting rod 3 with a central recess, has outlet openings 18, with which the oil supplied can be fed to cavities 10, or cavities 10 formed by channels, which cavities 10 are formed in the piston crown of the piston 2. As the piston 2 is braked as the piston 2 approaches top dead center, oil located in the oil feed line 9 is forced into the cavities 10 through the connecting or retaining part 19 and the outlet openings 18. This oil flows via annular or reversing chambers 28 formed peripherally in the piston crown 21 and into return lines 11 likewise formed in the piston crown 21 and from these return lines 11 into at least one oil return line 12, which is formed in the connecting rod 3.

The cavities 10 or the channels forming these cavities 10, starting from the connecting rod 3 or from the connecting or retaining part 19, run to the circumference of the piston 2, rising slightly at an angle W. The reversal chambers 28 are formed by peripherally located cavities or channels. The return lines 11 leading back from these reversal chambers 28 to the connecting rod 3 are likewise of inclined design, but the openings of the return lines 11 into the reversal chambers 28 and into the oil return line 12 are located further away from the combustion chamber and from the piston face 31 on the combustion chamber side than the connections of the cavities 10 to the retaining part 19 or to the reversal chamber 28.

It is expedient if the cavity 10 or the channels forming the cavity 10 and/or the return line 11 are inclined at an angle W of 1° to 4°, preferably 1° to 3°, to a plane perpendicular to the piston longitudinal axis K, the peripheral end of the cavity 10 or of the channels forming the cavity 10 being located closer to the piston face 31 on the combustion chamber side than the return line 11.

Formed in the guide 15 is at least one groove 23, in which there is arranged a metallic oil scraper ring 20 for the connecting rod 3, sealing off on the inside, the inlet opening 14' of an oil return channel 14 adjoining or opening in the surface of the guide 15 on the side of the oil scraper ring 20 remote from the combustion chamber, the other end of said channel being led into the crankcase. The oil return channel 14 is led in the guide 15 and in the cylinder 1 in such a way that, in the position of use of the cylinder 1, it is directed downward and permits return delivery of oil under gravity.

The oil feed line 9 formed in the connecting rod 3 has, in the end area thereof remote from the combustion chamber, a transfer channel 16, which opens into the bearing recess 27 of the transverse bearing 6, in order to perform lubrication of the sliding block 5. Therefore, the to and fro movement of the sliding block 5 and of the rollers 8 in the bearing recess 27 is pressure-lubricated. As a result of the braking of the piston 2 as the latter approaches top dead center, oil located in the oil feed line 9 is forced into the bearing recess 27 through the transfer channel 16 on account of the mass inertia.

Figure 2:
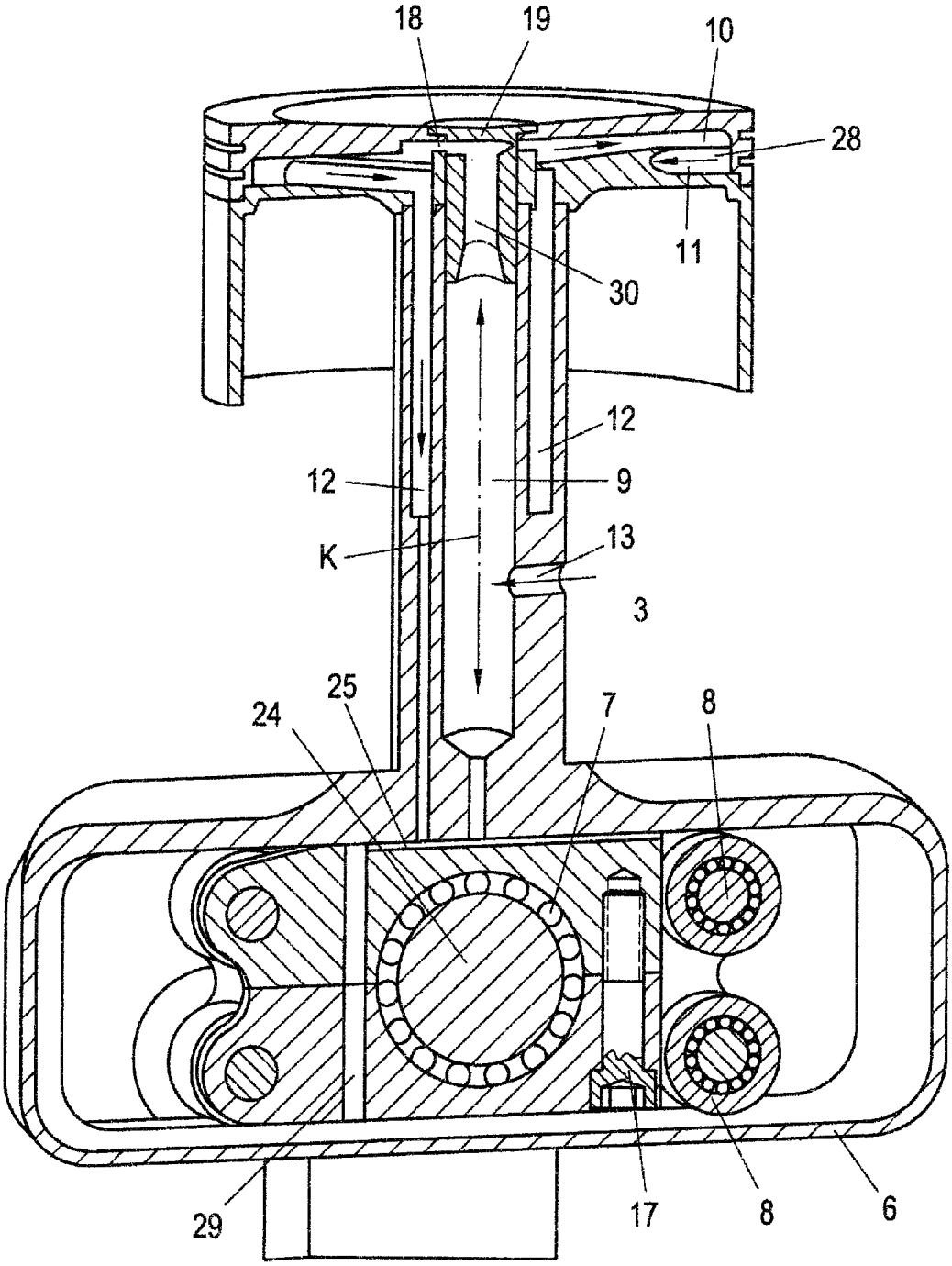
FIG. 2 shows a transverse bearing which is located between a connecting rod and a crankshaft, the connection between connecting rod and piston also being made with the aid of a connecting screw.

As FIG. 2 reveals, the transverse bearing 6 and the bearing recess 27 thereof have a rectangular inner cross section, possibly with inner corners having a rounded course. Furthermore, it can be seen from FIG. 3 that the oil return line 12 opens directly into the bearing recess 27 via the transfer channel 16.

Figure 3:
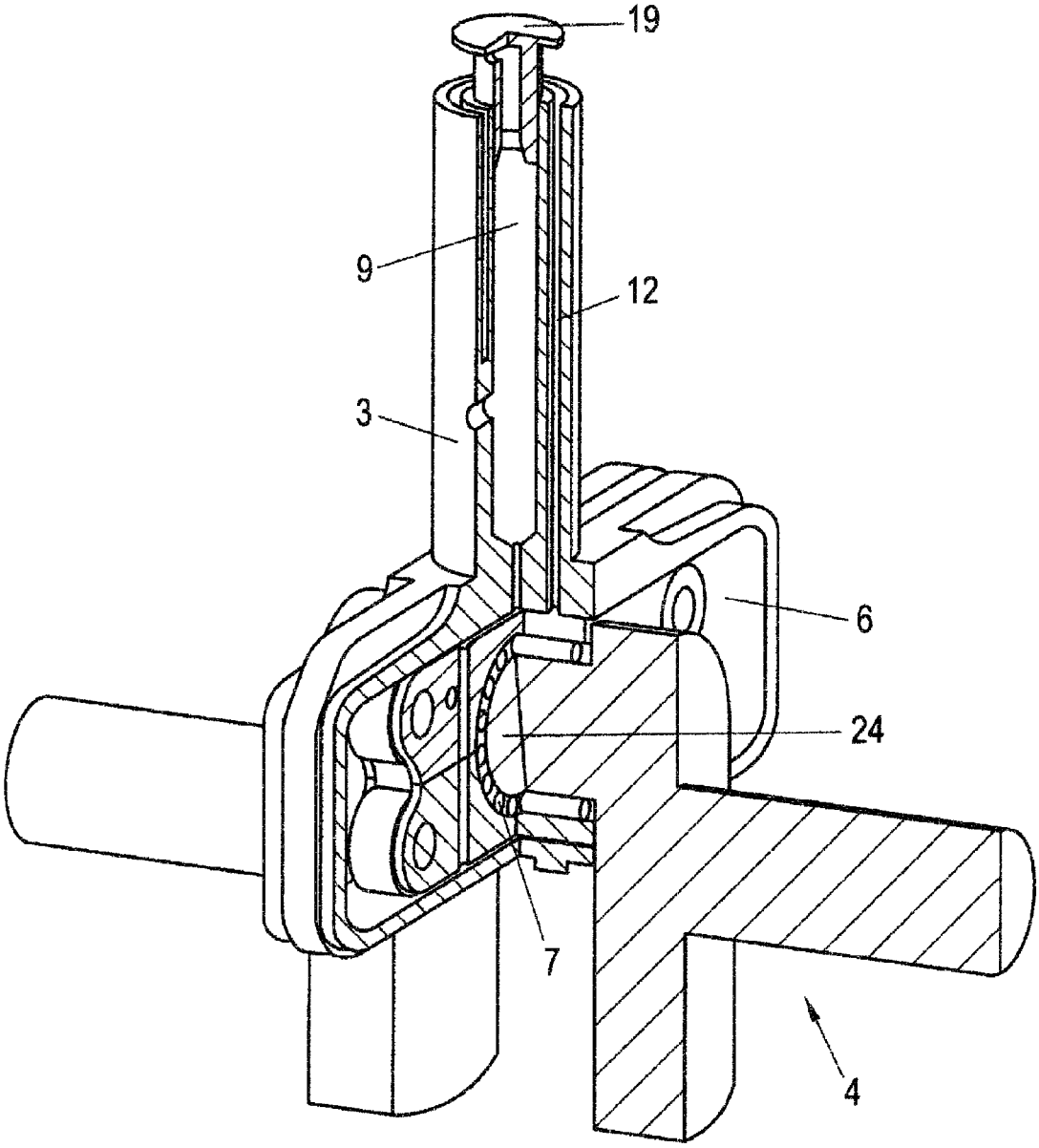
FIG. 3 shows a schematic view of a bearing connection with connecting rod and transverse bearing, which are fabricated from a single component.

The mounting of the crankpin 24 in the needle bearing 7 of the sliding block 5 can be gathered from FIGS. 2 and 3. It can also be gathered from these two FIGS. that the oil return line 12 in the connecting rod 3 is designed in the form of parts of a cylindrical ring.

Figure 4:
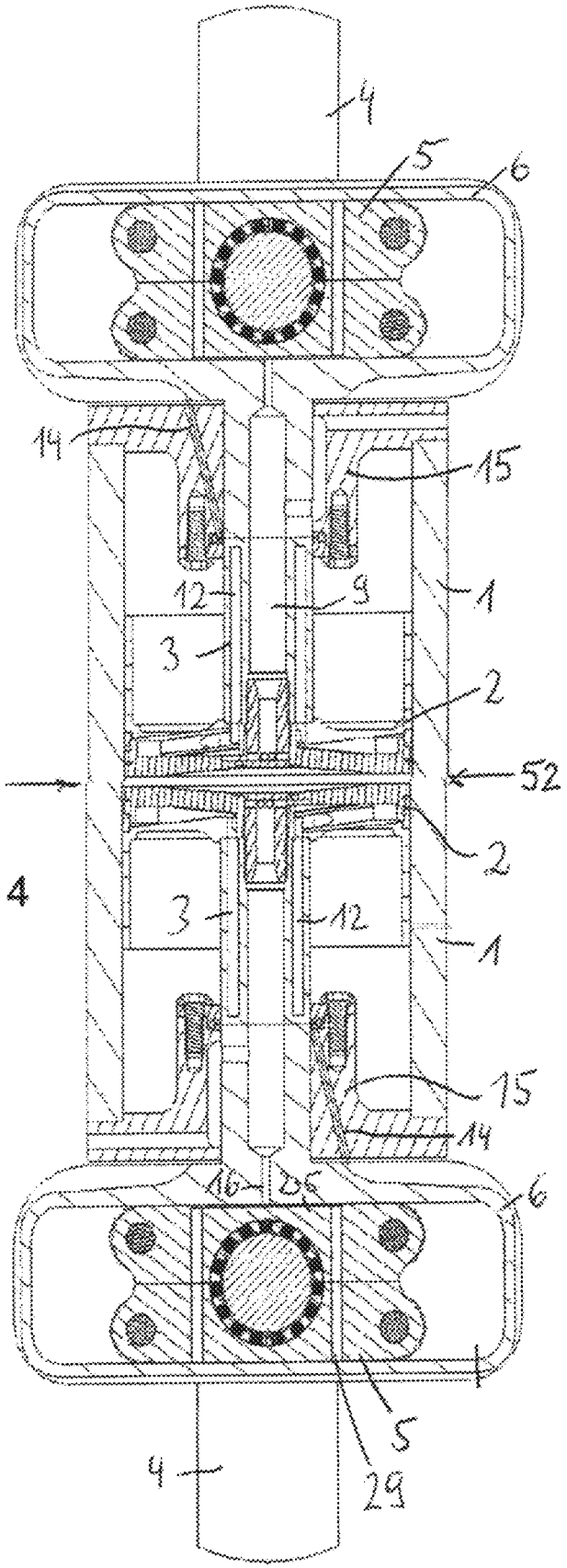
FIG. 4 shows a schematic section through an opposed-piston engine according to the invention.
Figure 5:
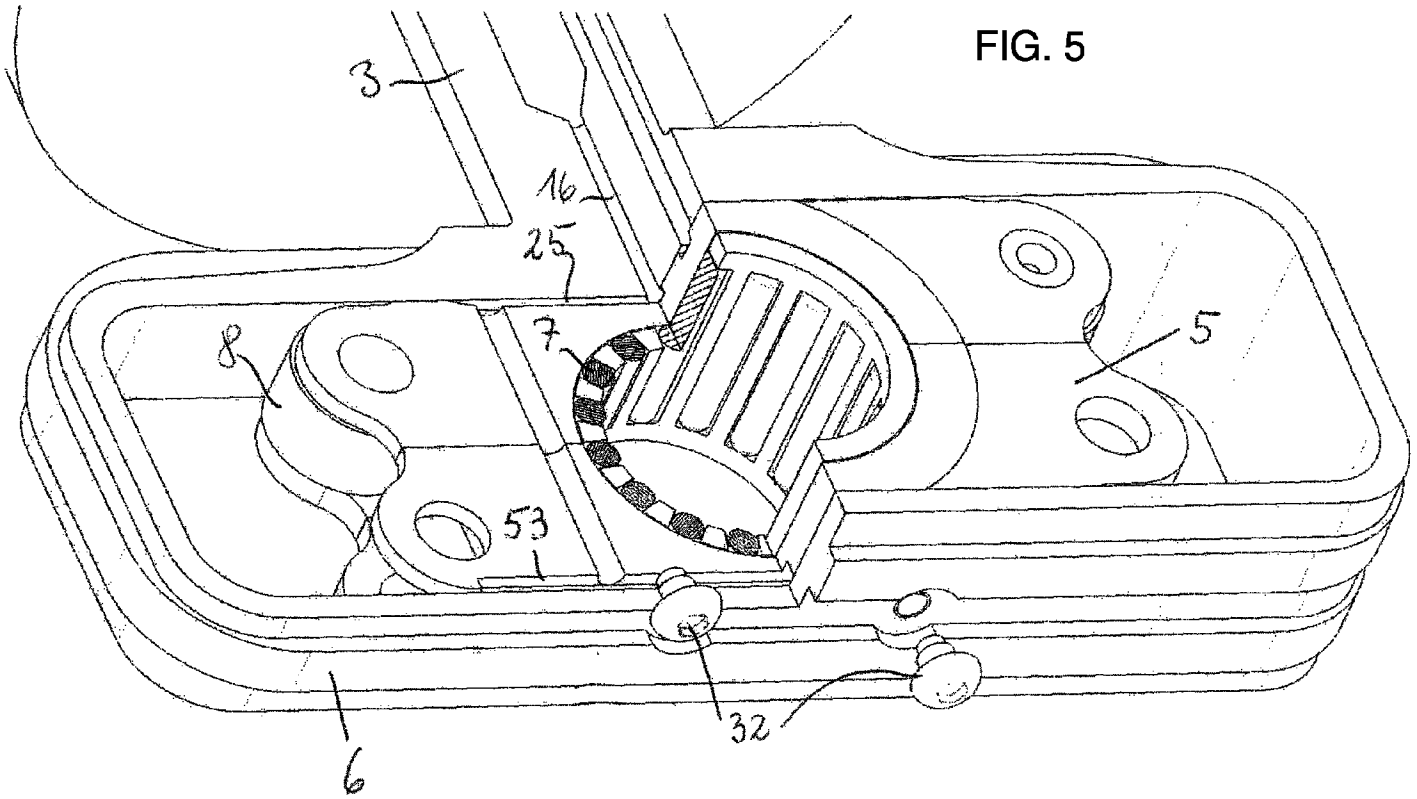
FIG. 5 shows an anti-rotation safeguard and a guide unit for a sliding block of a transverse bearing.

FIG. 4 shows a schematic section through an opposed-piston engine according to the invention having pistons and cylinders according to the invention. With regard to a mid-plane 52, this opposed-piston engine is for the most part constructed symmetrically or in mirror-image fashion and with cylinders rotated through 180°. The opposed-piston engine comprises two cylinders 1 according to the invention, which are connected to each other by the circumferential walls thereof on the combustion chamber side. In principle, such a cylinder could also be formed in one piece. In the cylinder 1 there are arranged two pistons 2 according to the invention, to each of which a connecting rod 3 is rigidly fixed. The connecting rods 3 are guided in guides 15 which are connected to the cylinder at the two ends thereof remote from the combustion chamber and close off said ends. Molded onto the connecting rods 3 are transverse bearings 6, in each of which a sliding block 5 is mounted such that it can move to and fro and in which the crankshaft 4 is mounted by the crankpin 24. Apart from the oil return channels 14, in the present case the structure of the opposed-piston engine according to the invention is symmetrical with respect to the mid-plane 52.

The sliding block 5 can also be placed on crankshafts 4 formed in one piece, by the rolling contact bearing 7 being chosen to be appropriately large or having a groove for the insertion of the rollers after the sliding block 5 has been placed on the respective crank rocker or the crankpin 24.

The sliding block 5 and the transverse bearing 6 can be fixed in one plane by a guide unit 53, 32 and secured against mutual rotation about the piston axis K. In order to connect sliding block 5 and transverse bearing 6 and crankpin 24 and piston 2 in an angularly fixed manner, in the sliding face of the sliding block 5 that is remote from the combustion chamber there can be formed a groove 53, into which at least one bolt or pin or profiled part 32 can be introduced or screwed, which is inserted through that wall part of the transverse bearing 6 which is preferably remote from the combustion chamber, projects into the groove 53 and guides the sliding block 5 relative to the transverse bearing 6. It is also possible for such guides 32 to be used in a plurality or on both sides of the piston axis. As a result of forming such an anti-rotation or axial safeguard, it is possible to avoid the situation where the transverse bearing 6 comes into contact with the crankshaft 4 or the crank rocker 24 during operation. It is also possible to insert into the transverse bearing 6 profiled parts configured in a different way from the profiled parts illustrated, for example a plate-like piece, which is held by securing screws and projects into the groove 53.

Figure 6:
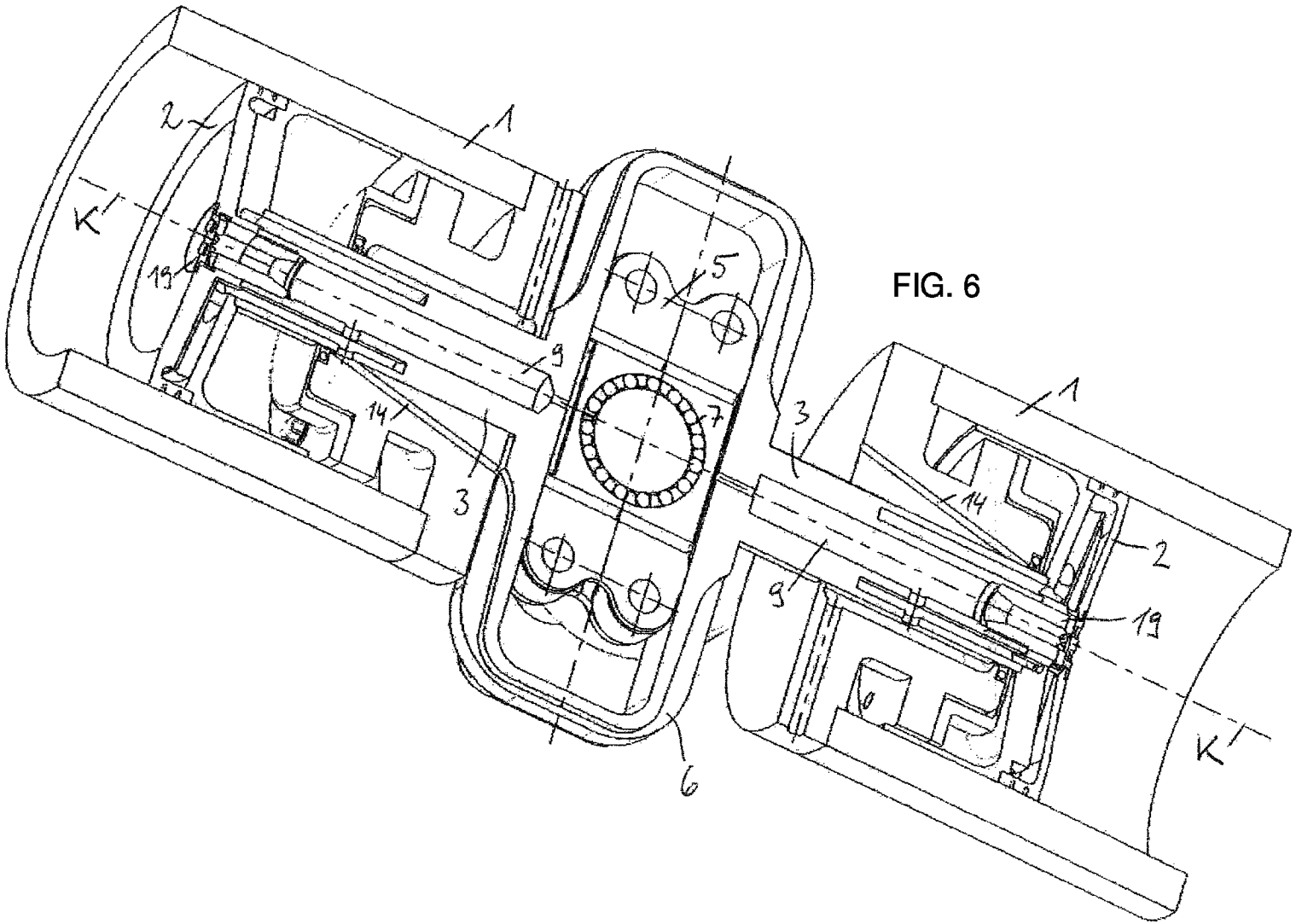
FIG. 6 shows a 180° V engine in schematic form.

FIG. 6 shows an embodiment of an engine in which there are arranged two identically configured cylinders 1, in particular rotated through 180° in relation to each other, the two connecting rods of the pistons 2 respectively arranged in the cylinders 1 being connected to one and the same transverse bearing 6. This connection is advantageously made in such a way that the connecting rods 3 and the transverse bearing 6 are fabricated from a single part, in particular a precision cast part. The two pistons 2 are driven in opposite directions in the respective cylinders 1, so that both pistons 2 simultaneously exert force on the transverse bearing 6 and therefore on the crankshaft 4 in the same direction. In this way, a 180° V engine is created.

Figure 7:
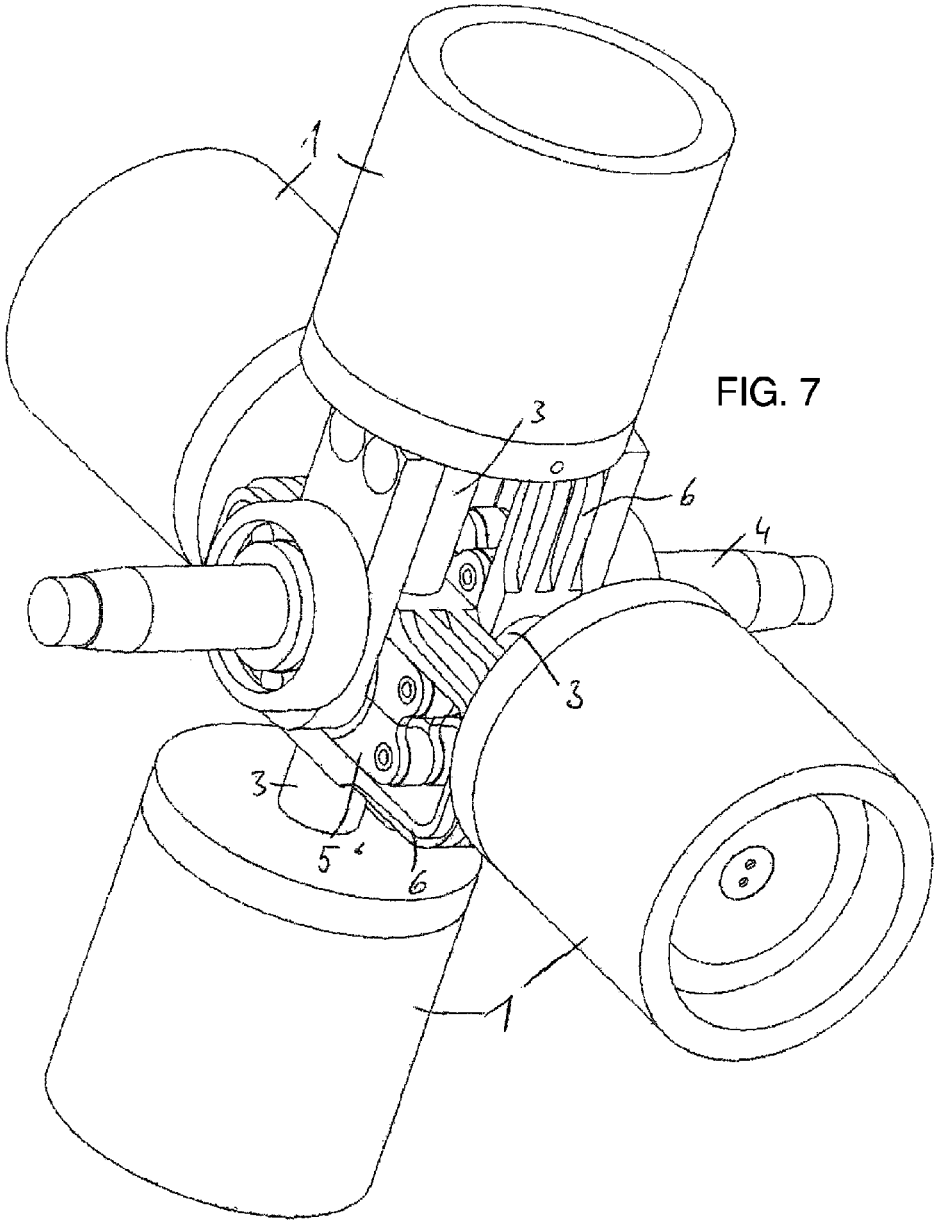
FIG. 7 shows a 4-cylinder star arrangement having two 180° V engines in schematic form.

FIG. 7 shows an arrangement of cylinders 1 of an engine for driving a crankshaft 4. The cylinders 1 are each located opposite one another in pairs and the connecting rods 3 of the respective pistons 2 located opposite one another in pairs are each connected to a transverse bearing 6, in which the sliding block 5 can be displaced to and fro. In this way, the 4-cylinder star arrangement illustrated in FIG. 7 of two 180° V engines having a bank angle of 90° is implemented.

However, it is readily also possible to create a double star arrangement, which means having two times four 180° V engines, i.e. with a total of 8 cylinders. The bank angle between the individual engines can be chosen as desired.

Figure 8:
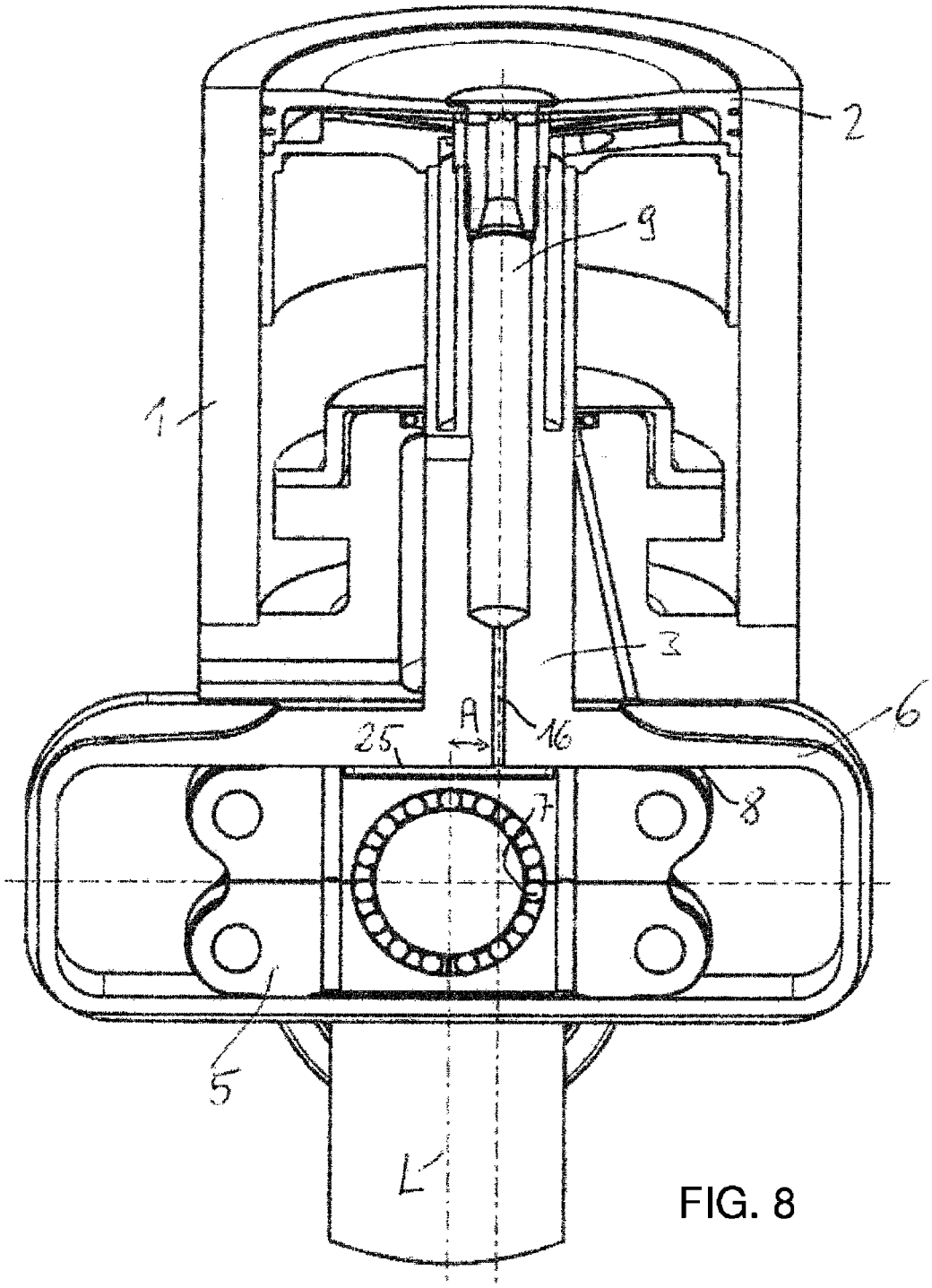
FIG. 8 shows an offset crank guide.

FIG. 8 shows an embodiment of a cylinder 1 having an offset crank guide 24. The crank guide 24 is arranged to be offset with respect to the connecting rod 3 and the axis of the connecting rod 3 is located at a distance A from the longitudinal mid-plane L of the transverse bearing 6, the longitudinal mid-plane L being perpendicular to the direction of movement of the sliding block 5 and parallel to the piston axis K.

Figure 9:
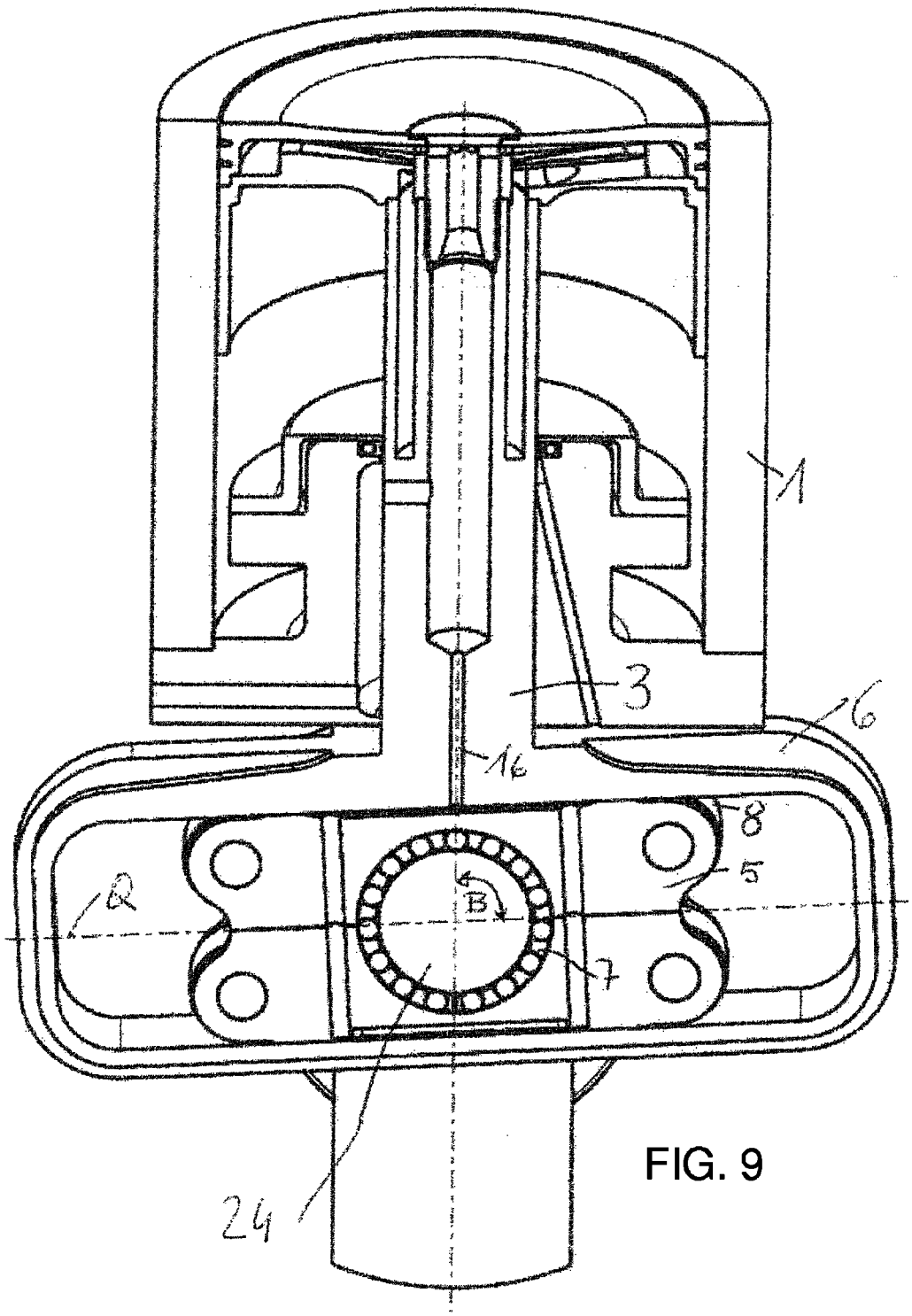
FIG. 9 shows an inclined crank guide.

FIG. 9 shows an embodiment of a cylinder 1 having a transverse bearing 6 inclined in relation to the connecting rod 3. The crank guide 24 is of inclined design and the transverse mid-plane Q of the transverse bearing 6 forms an angle B of 84 to 89°, preferably 85 to 89°, with the connecting rod 3.

The angle B and the distance A are matched to the respective intended use.

If the crank drive is offset in order to reduce the lateral piston force, an improvement in the dynamics and a reduction in the bending moment in the area of the connecting rod bearing are achieved. Advantageously, in the event of an offset, the cylinder mid-line is offset by about 4 to 10% of the cylinder bore before the crankshaft mid-line in the direction of rotation.

The transverse bearing 6 is advantageously formed with the connecting rod 3 as a component consisting of one piece. In principle, it is also possible to connect, for example to weld and/or to screw, the connecting rod 3 to the transverse bearing 6.

The annular chamber 28 is advantageously continuously open and constitutes the area of the cavity 10 closest to the combustion chamber.

The crankshaft is advantageously formed in one piece.

Figure 10:
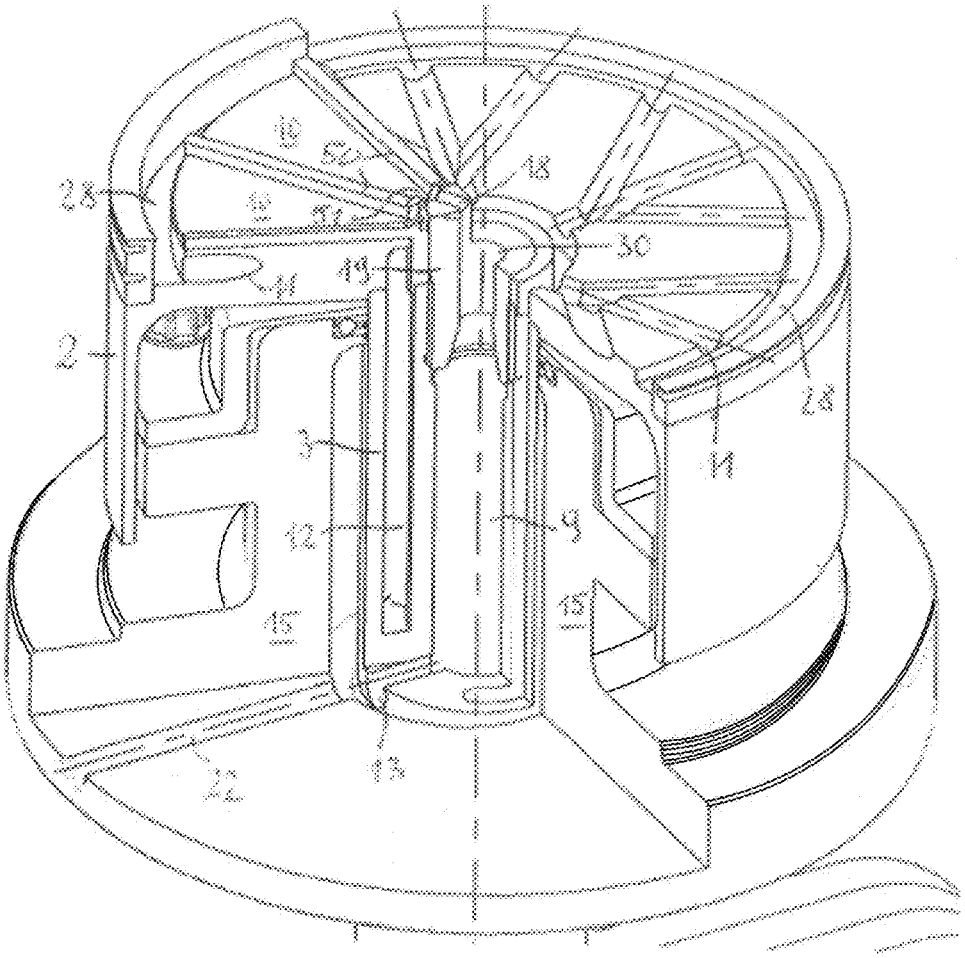
FIGS. 10 and 11 show detail views of a piston.

FIG. 10 shows a schematic sectional view of a piston 2 as can be used in a cylinder 1. The piston crown has been left out, so that the cavities 10 and the return lines 11 which communicate with the annular chamber 28 running around peripherally can be seen. The guide component 15 is matched closely to the rear wall or the wall form of the piston 2 remote from the combustion chamber, in order in any case to be able to perform compression of the charge air. The cavities 10 have a base area in the form of a circular sector and are separated by lands 50 which, if appropriate, can also specifically delimit the inlet openings 51 into the cavities 10.

The volume and the cross-sectional course of the cavities 10 and of the return lines 11 are formed specifically in order to exert an influence on the flow of oil.

Figure 11:
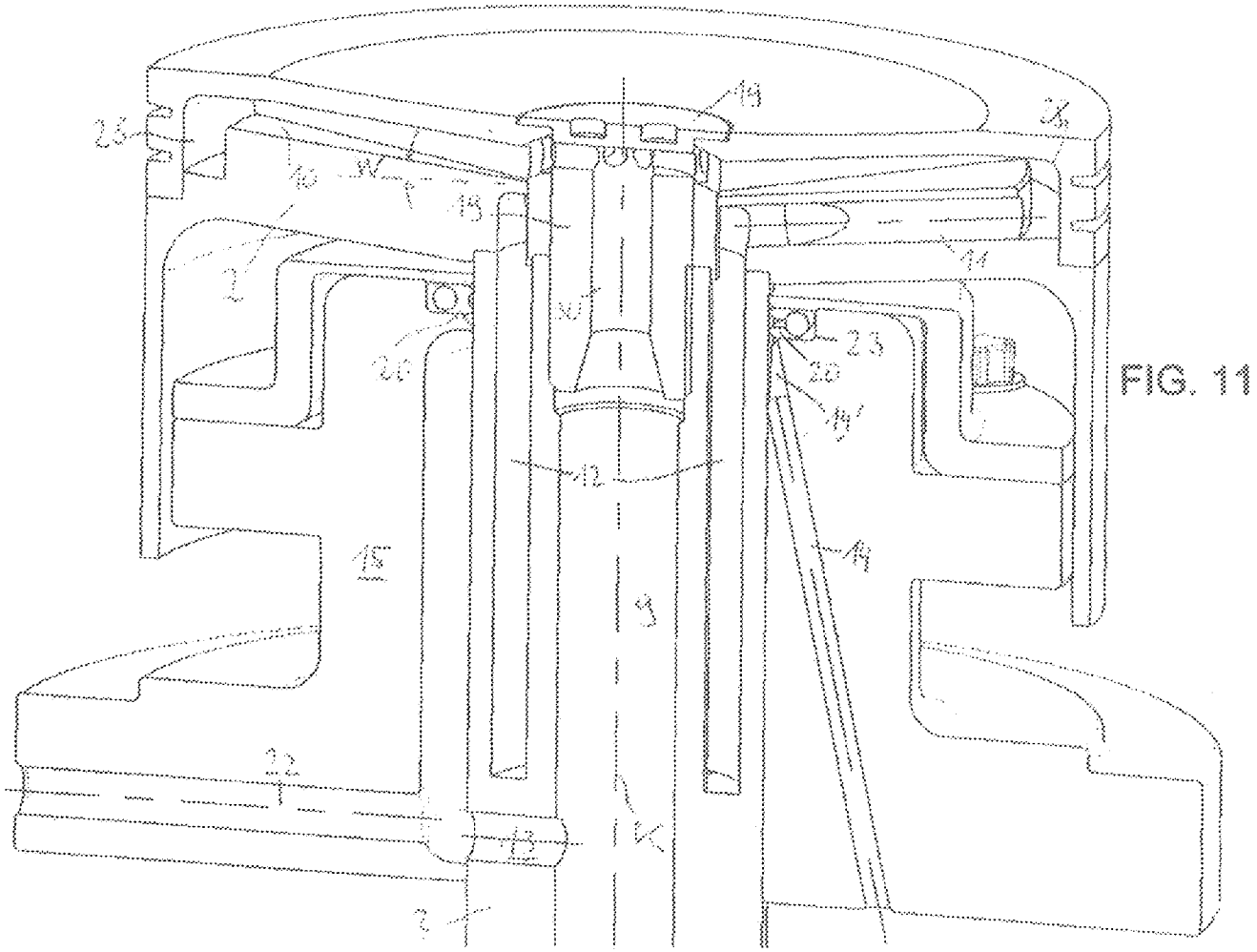

FIG. 11 shows a detail view from which the oil return channel 14 running in the guide 15 can be seen, the inlet opening 14' of which opens into the guide chamber in which the connecting rod 3 is mounted such that it can move up and down. The angle of inclination W of the cavities 10 and of the return lines 11 in relation to the piston axis K can be seen clearly.

Figure 12:
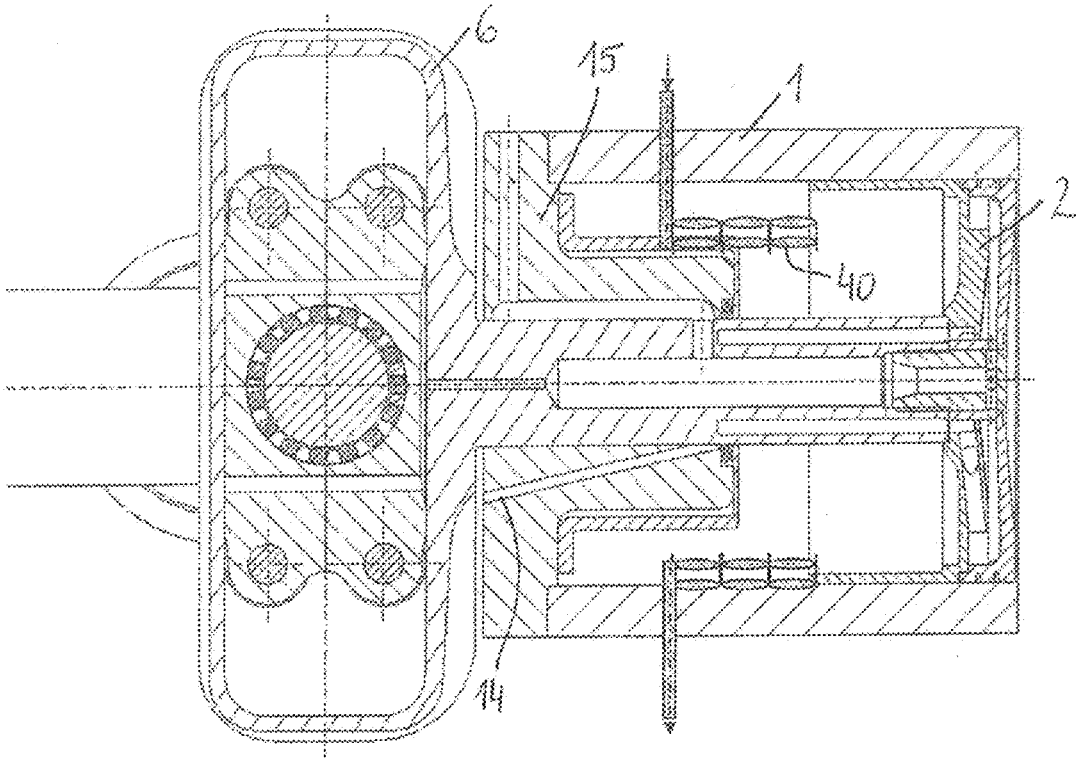
FIG. 12 shows a cylinder with charge air cooler.

FIG. 12 shows a cylinder 1 in which a charge-air cooler or heat exchanger 40 which lies in the pre-compression chamber is carried by the guide part 15. The heat exchanger 40 could also be arranged on or fixed to the wall of the cylinder 40. The heat exchanger 40 is located in the volume which is formed and bounded by wall surfaces of the guide 15, of the cylinder 1 and of the piston rear wall and permits cooling of the charge air led through this chamber. In this pre-compression chamber, the heat exchanger 40 can be operated with engine oil as a cooling liquid or with a coolant formed with water and glycol. The coolant circuit could be connected to the water cooling of the engine cylinder. In the case of oil cooling, the cooling oil which is used for the cooling of the piston 2 could also be used as heat exchanger fluid. The operating temperatures of the cooling oil are about 120° to 140°, whereas the temperature of the water cooling in a two-stroke cylinder is kept low and is around 55° C. to 80° C. Cooling of the heat exchanger 40 with water or a water-antifreeze agent is thus to be preferred, since water, as compared with oil, also has a more beneficial specific heat, with which more effective transport of heat away is achieved. The guides for the charge air are not illustrated in FIG. 12.

The invention claimed is:

1. A bearing connection having a connecting rod connected rigidly to a piston and a crankshaft driven by the connecting rod, the connecting rod being connected on the crankshaft side to a transverse bearing for a sliding block, the sliding block being mounted such that it can move to and fro in the transverse bearing and a rolling contact bearing being arranged in the sliding block in order to receive the crank pin of a crankshaft, wherein at least one cavity is formed in the piston crown and, in the area thereof close to the piston longitudinal axis, is connected to an oil feed line running through the connecting rod and in that the oil feed line in the connecting rod is led or extended to the end region thereof remote from the piston and, from there, is led onward into the interior of the transverse bearing via a transfer channel.

2. The bearing connection as claimed in claim 1, wherein the transverse bearing and the connecting rod are formed in one piece or from one part, in particular a precision cast part.

3. The bearing connection as claimed in claim 1, wherein the sliding block is formed in two parts, and the two parts enclose the rolling contact bearing, preferably a needle bearing, for the crank pin, or in that the sliding block is formed in one piece and the rolling contact bearing has a filling groove and the rolling contact bearing is threaded onto the crank pin.

4. The bearing connection as claimed in claim 1, wherein the sliding block is guided in the transverse bearing such that it can be displaced on rollers in a direction transverse to the cylinder longitudinal axis.

5. The bearing connection as claimed in claim 1, wherein the transverse bearing or the bearing recess thereof has a rectangular internal cross section, if appropriate with internal corners having a rounded course.

6. The bearing connection as claimed in claim 1, wherein the cavity is formed by a number of channels preferably running radially in the piston crown, possibly connected to one another, in particular connected to one another and/or branching in the circumferential region of the piston.

7. The bearing connection as claimed in claim 6, wherein the cavity or the channels forming the cavity in the circumferential region of the piston are connected, possibly via a collecting line running peripherally, to at least one return line leading to the connecting rod, the return line being connected to an oil return line guided in the connecting rod, and the cavity or the channels forming the cavity being closer to the end face of the piston than the return lines.

8. The bearing connection as claimed in claim 6, wherein the oil feed line is guided centrally in the connecting rod and/or in that an oil return line connected to the return line is arranged peripherally or off-center in the connecting rod.

9. The bearing connection as claimed in claim 6, wherein the piston is formed centrally symmetrically with respect to the longitudinal mid-axis thereof and/or in that the piston is connected to the connecting rod via a connecting part, preferably in the form of a hollow screw, firmly and rigidly, but if appropriate detachably and divisibly, the oil feed line being extended into a recess in the connecting part which, in the top area of the connecting part, has outlet openings which open into the cavity or the channels forming the cavity.

10. The bearing connection as claimed in claim 6, wherein a connecting bore is formed in the connecting rod at a distance from the piston and leads radially from the surface of the connecting rod to the centrally placed oil feed line.

11. The bearing connection as claimed in claim 6, wherein the cavity or the channels forming the cavity and/or the return line are inclined at an angle of 1° to 4°, preferably 1° to 3°, to a plane perpendicular to the piston longitudinal axis, the peripheral end of the cavity or of the channels forming the cavity being closer to the piston surface on the combustion chamber side than the return line.

12. The bearing connection as claimed in claim 6, wherein the transfer channel opens into a bearing recess enclosed by the transverse bearing and/or in that a bore is formed in the sliding block and passes through the sliding block between the opposite wall faces of the latter and/or in that, in the wall surface of the sliding block close to the piston, a depression located opposite the connecting rod is formed, in the area of which the transfer channel opens, which depression has at least one transverse extent which corresponds to the offset of the sliding block during the to and fro movement of the latter.

13. The bearing connection as claimed in claim 1, wherein the transverse bearing is connected to a respective connecting rod on opposite sides, the two connecting rods preferably being aligned coaxially.

14. The bearing connection as claimed in claim 1, wherein the sliding block and the transverse bearing are fixed in one plane by a guide unit and are secured against mutual rotation about the piston axis.

15. An engine cylinder comprising a piston and a connecting rod and having a bearing connection according to claim 1, wherein the cylinder has a guide or a guide part, in which the connecting rod is mounted and guided, in the base area of the cylinder remote from the combustion chamber.

16. The cylinder as claimed in claim 15, wherein the guide closes off the cylinder or the end of the latter remote from the combustion chamber, and/or in that a charge-air cooler or heat exchanger is arranged in the pre-compression chamber, in particular is carried by the guide.

17. The cylinder as claimed in claim 15, wherein an oil supply line is formed in the guide along the guide path for the connecting rod and communicates with the connecting bore, at least over half the piston travel to or from the top dead center of the piston.

18. The cylinder as claimed in claim 15, wherein in the guide there is formed at least one groove, in which a metallic oil scraper ring for the connecting rod is arranged, sealing off on the inside.

19. The cylinder as claimed in claim 18, wherein the inlet opening of an oil return channel opens in the surface of the guide on the side of the oil scraper ring remote from the combustion chamber, the other end of said channel, falling or having a vertical directional component, being led into the crankcase in the position of use.

20. The cylinder as claimed in claim 15, wherein the crank guide is arranged to be offset with respect to the connecting rod, and the connecting rod leaves the transverse bearing at the distance from the longitudinal mid-plane of the latter.

21. The cylinder as claimed in claim 15, wherein the crank guide is of offset design, and the transverse mid-plane of the transverse bearing forms an angle of 84° to 89°, preferably 85° to 88°, with the connecting rod.

22. An opposed-piston engine, comprising two cylinders as claimed in claim 15 joined together to form one cylinder, each having a piston mounted therein that is respectively connected to a crankshaft by the bearing connection as claimed in claim 1, which cylinders executing strokes in opposite directions are connected to each other by the end regions thereof on the combustion chamber side, preferably by end faces of the cylinder wall, are advantageously formed in one piece or one part and form a continuous cylinder wall.

23. An engine, in particular a 180° V engine, having two cylinders as claimed in claim 15 each having a piston with connecting rod and having a bearing connection as claimed in claim 1, the two cylinders being arranged on both sides of the crankshaft, and the connecting rod of each cylinder being connected, preferably in one piece, to the transverse bearing placed on the crank pin.

* * * * *